US006116382A

United States Patent [19]

Deramaux et al.

[11] Patent Number: 6,116,382

[45] Date of Patent: Sep. 12, 2000

[54] BRAKING DEVICE FOR A RAILWAY VEHICLE

[75] Inventors: Jean-Michel Deramaux, Saint-Saulve; Bernard Caron, Aulnoye-les-Valenciennes, both of France

[73] Assignee: Societe des Forges de Fresnes, Fresnes-sur-Escaut, France

[21] Appl. No.: 08/952,508

[22] PCT Filed: May 30, 1996

[86] PCT No.: PCT/FR96/00810

§ 371 Date: Jan. 28, 1998

§ 102(e) Date: Jan. 28, 1998

[87] PCT Pub. No.: WO96/38330

PCT Pub. Date: Dec. 5, 1996

[30] Foreign Application Priority Data

May 31, 1995 [FR] France ..... 95 06469

[51] Int. Cl.[7] ..... B61H 11/14; B61H 13/20

[52] U.S. Cl. ..... 188/58; 188/70 R; 188/59; 188/72.6; 188/72.9; 188/33; 188/153 R; 188/219.1

[58] Field of Search ..... 188/70 R, 72.9, 188/72.6, 205 A, 206 A, 33, 34, 4–59, 219.1–233.7, 153 R, 153 A, 151 R, 72.2, 72.7, 2 A, 79

[56] References Cited

U.S. PATENT DOCUMENTS

| | | | |
|---|---|---|---|
| 343,680 | 6/1886 | Tribe . | |
| 595,496 | 12/1897 | Pickles . | |
| 2,228,818 | 1/1941 | Eksergian . | |
| 2,359,806 | 10/1944 | Tack . | |
| 2,581,746 | 1/1952 | Basalt . | |
| 2,866,524 | 12/1958 | Flesch . | |
| 2,869,683 | 1/1959 | Busch | 188/206 R |
| 2,876,869 | 3/1959 | Coskun | 188/59 |
| 3,109,517 | 11/1963 | Butler et al. | 188/59 |
| 3,137,368 | 6/1964 | Press et al. . | |
| 3,624,765 | 11/1971 | Hauth | 188/72.6 |
| 3,791,491 | 2/1974 | Tickle | 188/70 R |
| 4,008,789 | 2/1977 | Clemmons | 188/70 R |
| 4,014,409 | 3/1977 | Haydu et al. | 188/58 |
| 4,015,691 | 4/1977 | Pöllinger et al. | 188/59 |
| 4,174,025 | 11/1979 | Irachev | 188/72.6 |
| 4,393,962 | 7/1983 | Kobalt | 188/59 |
| 4,473,136 | 9/1984 | Emilsson et al. | 188/59 |
| 4,592,451 | 6/1986 | Persson | 188/59 |
| 5,038,896 | 8/1991 | Wirth | 188/59 |
| 5,253,736 | 10/1993 | Kohler | 188/59 |
| 5,547,047 | 8/1996 | Kohar et al. | 188/59 |

FOREIGN PATENT DOCUMENTS

| | | | |
|---|---|---|---|
| 2194601 | 3/1974 | France . | |
| 2156629 | 11/1971 | Germany | 188/59 |
| 639160 | 3/1962 | Italy | 188/59 |
| 177924 | 11/1966 | U.S.S.R. | 188/59 |
| 1150862 | 5/1969 | United Kingdom | 188/59 |

*Primary Examiner*—Douglas C. Butler
*Attorney, Agent, or Firm*—Greenblum & Bernstein, P.L.C.

[57] ABSTRACT

The invention relates a braking device for a railroad vehicle including traction structure (1, 2) arranged to apply a braking pad on a braking surface affixed to a wheel of the vehicle. It includes a reaction member (11, 20), at least one lever (6; 6', 6"; 33, 33') arranged to cooperate with the reaction member, connecting structure (23, 41) between the traction structure and the lever, the braking pad being borne by the lever to be applied on the braking surface by pivoting of the lever under the action of the traction structure and of the reaction member.

4 Claims, 6 Drawing Sheets

BRAKING DEVICE FOR A RAILWAY VEHICLE

BACKGROUND OF THE INVENTION

1. Field of the Invention

The present invention relates to a braking device for a railroad vehicle, and such a device, more particularly, includes traction means arranged to apply a braking pad on a braking surface affixed to a wheel of the vehicle.

2. Description of Background and Relevant Information

Such devices are already known which are more particularly used on railroad freight cars. The braking pad acts by friction on the tire of the wheel to cause the braking. The traction means are generally constituted by a triangular member made of metallic bars and referred to as a brake triangle. This is an isosceles triangle, with its apex in the plane of symmetry of the car and its other two angles in the vicinity of two wheels of the car mounted on the same axle.

The braking force is applied at the apex of the triangle in the aforementioned plane of symmetry, and this force is also distributed between the two pads to apply them to the corresponding tire to cause the braking of the car.

Disk brakes, of the same type as those used in automobiles, are also known and are generally used on the motor coaches or passenger coaches. These brakes have the advantage of providing a very energetic braking, of being quieter and of generating less vibrations than the conventional brakes acting on the tires. However, they are very expensive and function in a total different manner. Therefore, they cannot be adapted to railroad vehicles provided with brake triangles.

SUMMARY OF THE INVENTION

The present invention aims at providing improved braking means for railroad vehicles. More particularly, it aims at providing a braking device combining the simplicity and robustness of the conventional brakes with a more efficient braking. It also has the object of providing such a device that can utilize the conventional braking chain having a brake triangle. In addition, it aims at increasing the braking capacity of such braking chains without increasing the braking force applied to the brake triangle, and to reduce the working noise, all for a favorable cost compared to that of a traditional disk brakes.

To this end, the object of the invention is a braking device for a railroad vehicle including traction means arranged to apply a braking pad on a braking surface affixed to a wheel of the vehicle, characterized in that it comprises a reaction member, at least one lever arranged to cooperate with said reaction member, connecting means between said traction means and said lever, said braking pad being borne by said lever to be applied on said braking surface by pivoting of said lever under the action of said traction means and of said reaction member.

The lever device according to the invention makes it possible to increase the braking force while maintaining the same braking control chain as in the conventional devices.

In a particular embodiment of the invention, said reaction member is constituted by the tire of a wheel of the vehicle, said lever cooperating with said tire by means of a support element.

More particularly, said support element can form a braking pad, said braking surface then forming a complementary braking surface.

The complementary braking surface makes it possible to increase the braking capacity with respect to a conventional triangle braking device. Nevertheless, as has been previously indicated, the braking control chain is the same as in these conventional devices.

In an alternative embodiment, the support element does not participate in the braking and is constituted, for example, by a roller rolling on the tire.

In another embodiment of the invention, the reaction member is affixed to the structure of the vehicle. Of course, in the case where the vehicle is a bogie coach, the reaction member is in fact affixed to the bogie structure.

This embodiment makes it possible to avoid involving the tire of the wheel in the braking process, and therefore to avoid damaging it. As a result, noise and vibrations are reduced.

Still in a particular embodiment of the invention, said lever includes two lever arms on both sides of its fulcrum pin, one of the lever arms carrying the support element and the other carrying the braking pad.

More particularly, said braking surface can be a cylindrical surface coaxial with the wheel.

Said braking surface can also be a planar annular surface substantially parallel to the plane of the wheel and coaxial with the wheel.

In this last case, in particular, the device according to the invention can include two affixed braking surfaces, each associated with a pad and with a lever, the two pads exerting their forces in opposite directions on their respective braking surface.

It is thus possible to globally increase the braking force, and therefore the braking capacity of the device, without increasing the force exerted on the traction means. Indeed, the force exerted on the braking surfaces will generally be exerted laterally and compensated for.

According to the particular embodiment described hereinabove, the device according to the invention can include two pad-holding levers and an operating lever, one of said pad-holding levers being mounted at its end opposite the pad, pivoting on the reaction member, said operating lever also being pivotally mounted on the reaction member and being connected to the traction means, the end of the other pad-holding lever, opposing the pad, being connected to the operating lever, and said pad-holding levers being connected in their central zone by a connecting link.

It can also include two pad-holding levers and a substantially at a right angle force transfer cylinder with a longitudinal piston connected to said traction means and a transverse piston, one of said pad-holding levers being pivotally mounted at its end opposite the pad on the reaction member, and the other pad-holding lever having its end opposite the pad connected to the transverse piston, and said pad-holding levers being connected in their central zone by a connecting link.

BRIEF DESCRIPTION OF THE DRAWINGS

Several embodiments of this invention will now be described, by way of a non-limiting example, with reference to the annexed schematic drawings in which.

DETAILED DESCRIPTION

Figure 1:
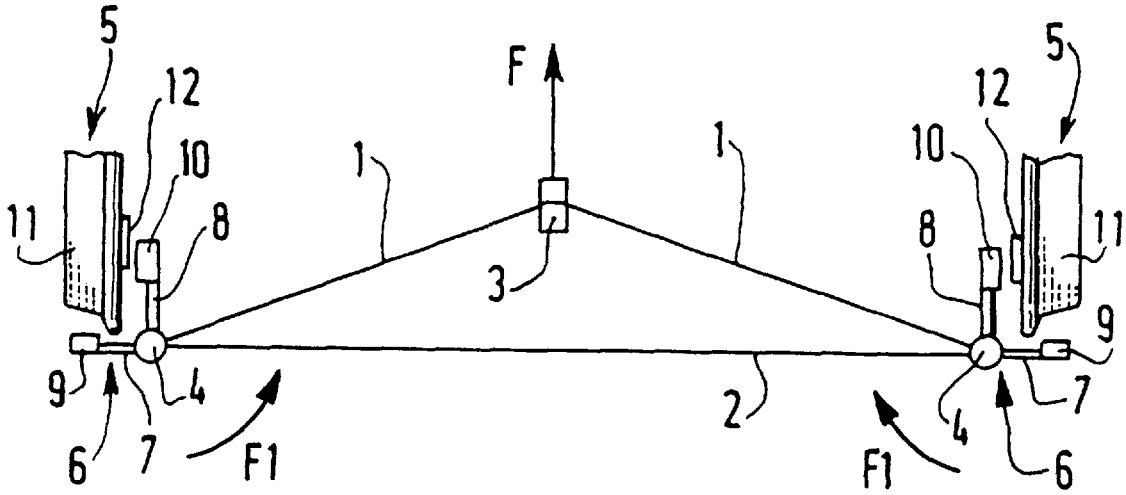
FIG. 1 illustrates a first embodiment of the invention.

FIG. 1 shows a brake triangle of a known type, formed of two metallic bars 1 of same length and of a third bar 2. A jack, not shown, makes it possible to exert a force illustrated by the arrow F at the point 3 common to the two bars 1.

The points 4 common, on the one hand, to the bar 2, and on the other hand, to each of the bars 1, respectively, are located in the vicinity of each of the wheels 5 carried by a same wheel shaft of the vehicle. When the traction force F is exerted at the point 3, the points 4 come closer to the wheels 5.

The points 4 are in fact hinge pins for the levers 6 each comprising two lever arms 7 and 8, respectively, at right angle. The lever arms 7 are substantially parallel to the axles of the wheels 5, whereas the arms 8 are substantially parallel to the axle of the vehicle.

The lever arms 7, at their end opposite the hinge 4, carry a braking pad 9 by means of a pad holder (not shown). Likewise, the arms 8 carry a pad 10, at their end opposite the hinge 4. The pads are made of cast iron in a known manner, and the pads 10 are made of a composite friction material.

When a traction is exerted on the brake triangle, the pads 9, in a known manner, come into contact with the tires 11 of the wheels 5, which results in providing a first braking force. By reaction, the levers 6 pivot in the direction of the arrows F1. In this movement, each pad 10 comes into contact with an annular friction band 11 located in a plane parallel to the plane of the wheel, which results in providing a second braking force.

The annular bands 12 are made of any suitable friction material. They are coaxial with the wheels 5 to which they are attached, and to which they are therefore affixed in rotation.

Therefore, it is noted that, for a same traction force F as in the devices of the prior art, the invention makes it possible to apply a first braking force F/2 on the tires of the wheels and, in addition, a second braking force on the bands 12. The two braking forces exerted on the two bands 12 are directed outwardly, and therefore opposed, which ensures the equilibrium of the brake triangle.

Figure 2:
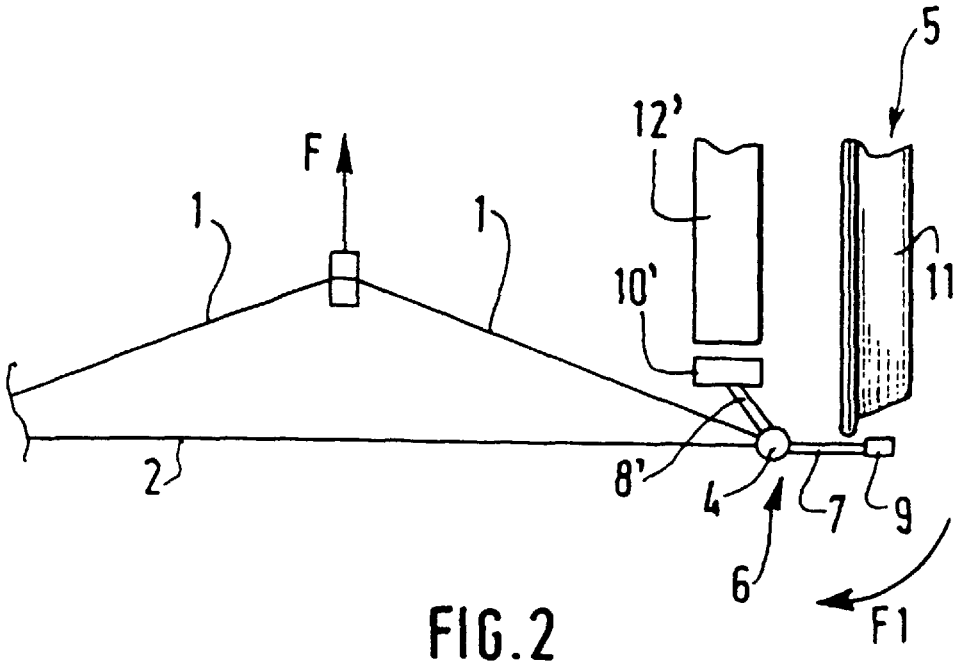
FIG. 2 illustrates a second embodiment of the invention.
Figure 3:
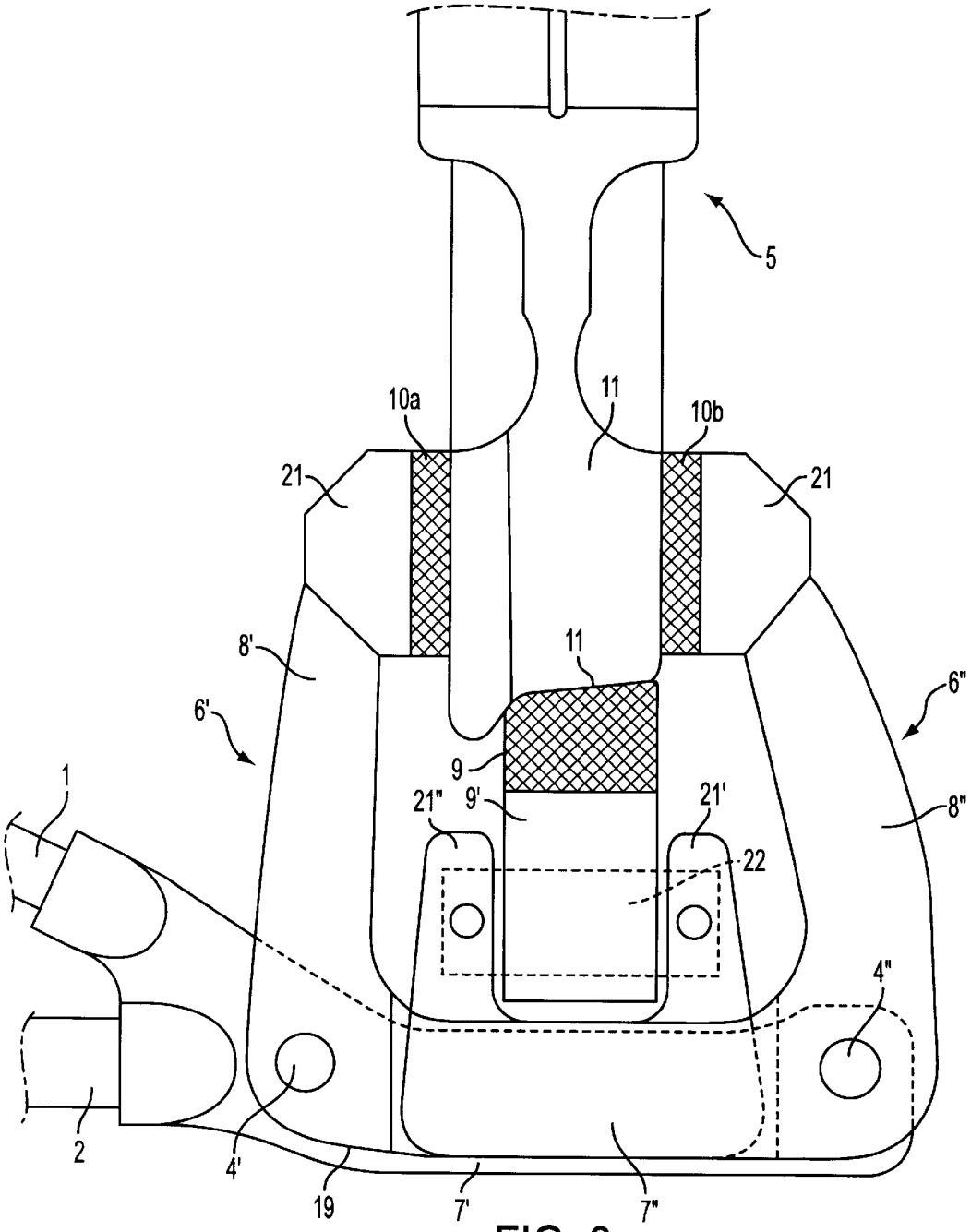
FIG. 3 is a partial top view of a third embodiment of the invention.
Figure 4:
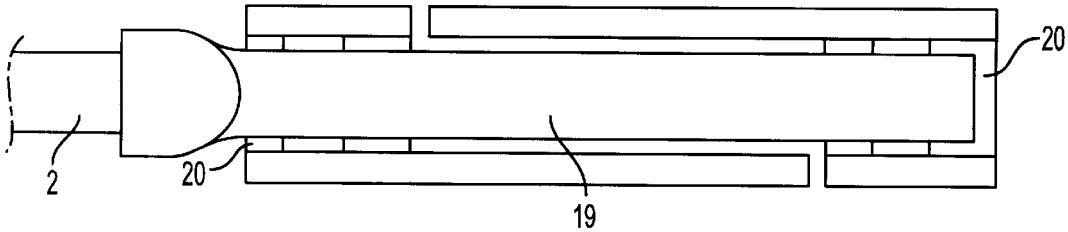
FIG. 4 is a front view.
Figure 5:
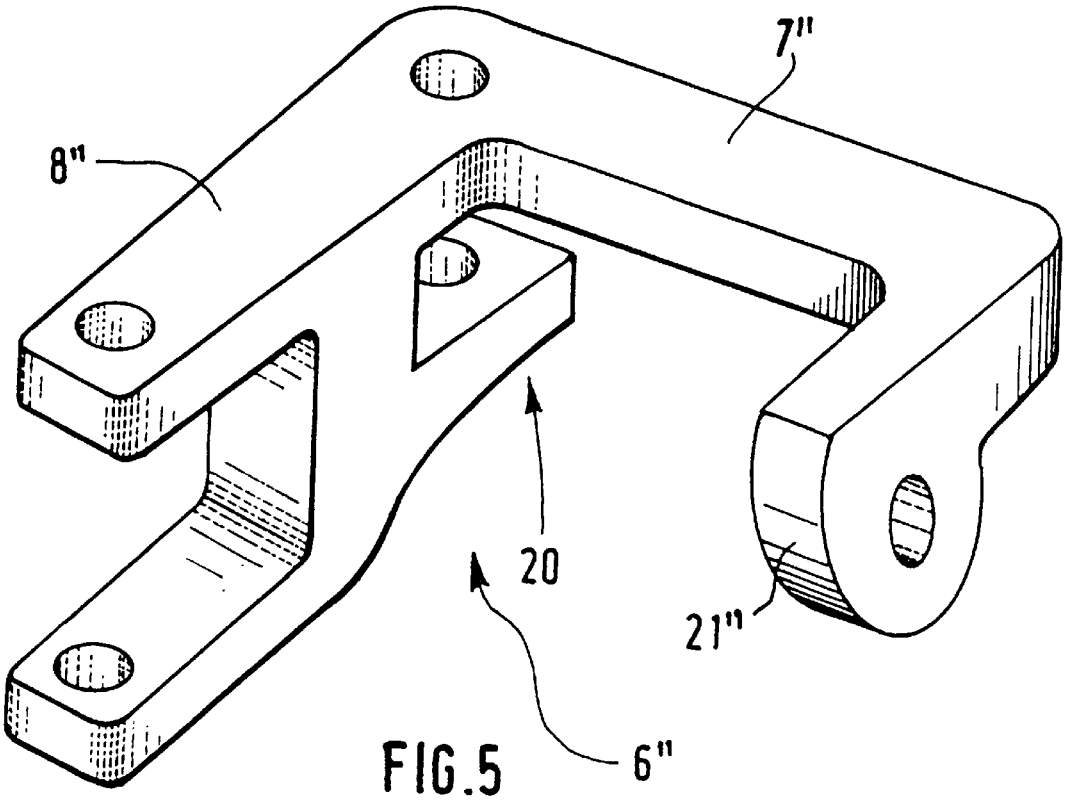
FIGS. 5 and 6 are perspective views of one of the levers of FIGS. 3 and 4.
Figure 6:
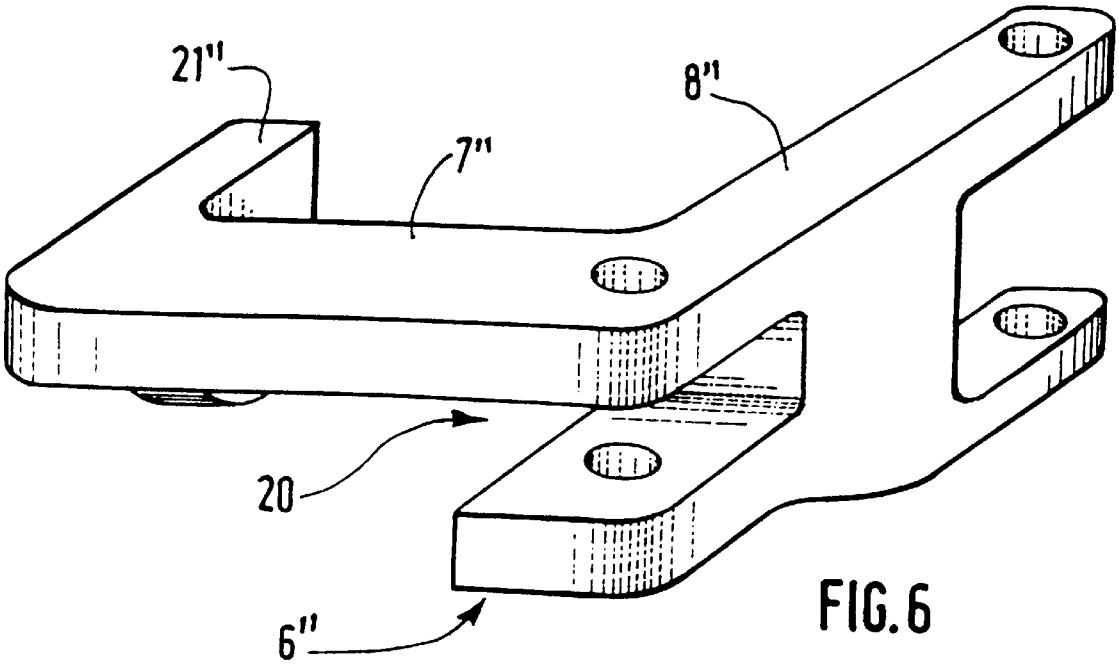

In the embodiment of FIG. 2, the lever arm opposite the lever arm 7, i.e., the lever arm 8', carries a pad 10' that cooperates with a cylindrical complementary braking surface 12', coaxial with the wheel 5. As previously, the tire 11 exerts on the pad 9 a reaction force which tends to cause the lever 6 to pivot about the hinge 4 in the direction of the arrow F1. The pad 10' is therefore applied against the surface 12', which, also in this case, provides a second braking force.

The embodiment of FIGS. 3–6 differs from that of FIG. 1, essentially in that it includes two levers 6' and 6" mounted on hinges 4' and 4". These hinges are here carried on an element 19 mounted at the end of the bars 1 and 2 and are constituted by caps 20 mounted on axles 4' and 4". The pad-holders 21 are mounted on the lever arms 8' and 8" and support the friction pads 10*a* and 10*b*.

The lever arms 7' and 7" here carry, at their end, return projections 21' and 21" which jointly receive a horizontal axle 22 parallel to the axle of the wheels, and support the pad-holder 9'. The axle 22 therefore connects the ends of the lever arms 7' and 7" and the pad holder 9'.

The wheel 5 here carries two complementary friction surfaces on which two pads 10*a* and 10*b* act. It is thus used as the disk in the known disc brakes.

When a traction is exerted on the brake triangle, the pad 9 is pressed on the tire 11 which pushes back the axle 22 and causes the levers 6' and 6" to pivot about the axles 4' and 4", such that the pads 10*a* and 10*b* are applied on the complementary braking bands.

Figure 7:
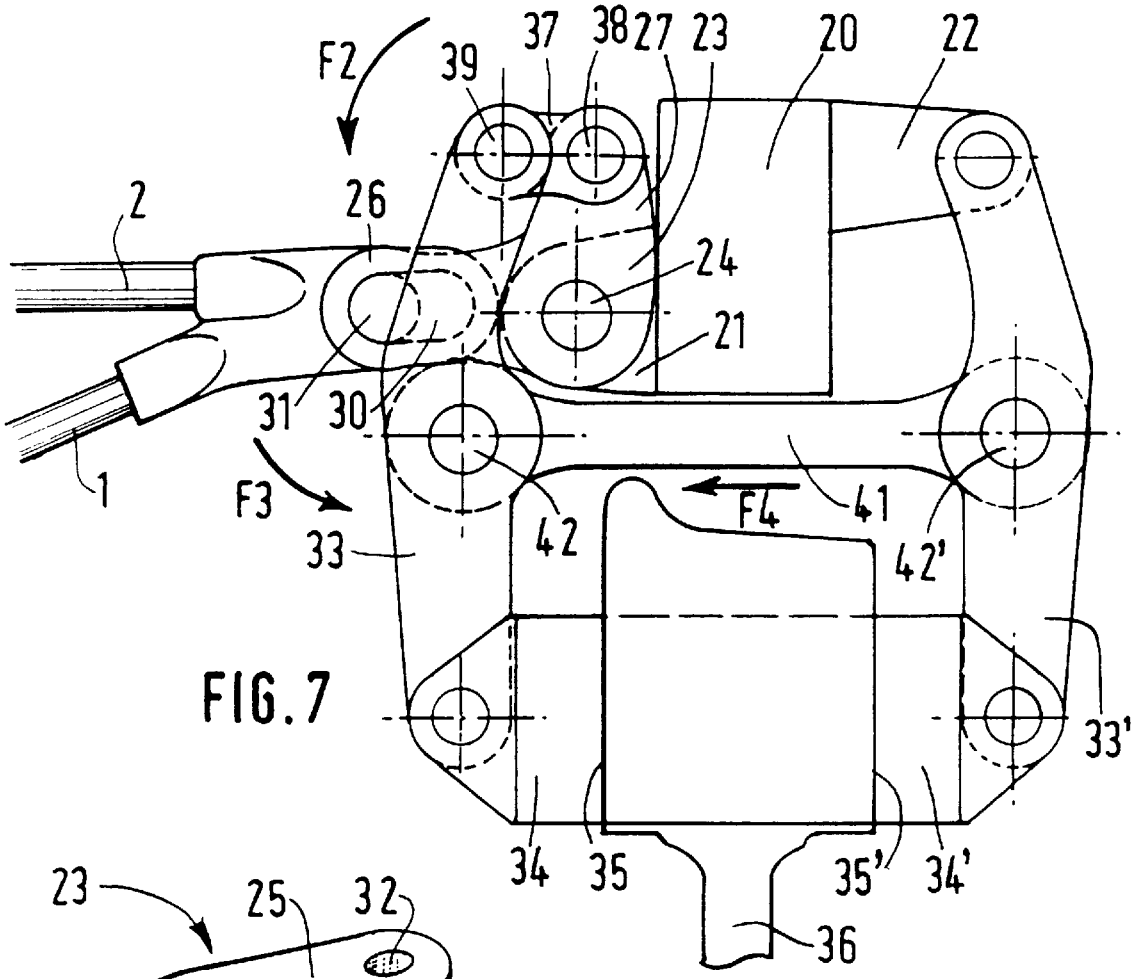
FIG. 7 is a top view of a fourth embodiment of the invention.
Figure 8:
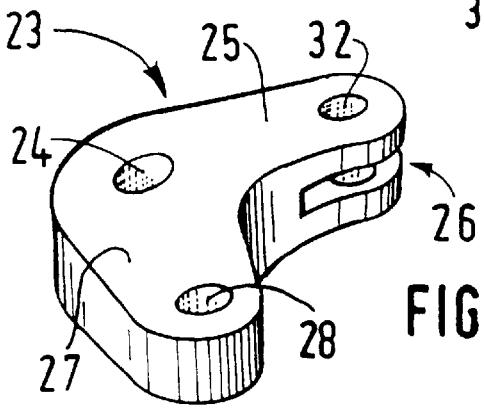
FIGS. 8 and 9 are perspective views of two of the members of the device of FIG. 7.
Figure 9:
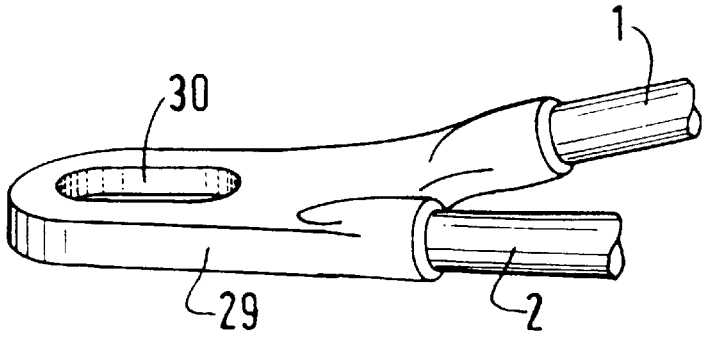

In the embodiment of FIGS. 7–9, the reaction member is a fixed member 20 affixed to the structure carrying the wheels, and therefore to either the wagon body or to the bogie structure. This member 20 supports two fixing lug 21 and 22 whose function will be discussed hereinafter.

A square-shaped operating lever 23 is mounted on the lug 21 to pivot in its center point about an axis 24. The end of one of its arms 25 forms a fork 26 and the end of its other arm 27 has a bore 28.

The end 29 of the brake triangle is made with an oblong opening 30 so as to engage within the fork 26. An axle 31 extends through the holes 32 of the fork 26 and 30 of the brake triangle.

One of the ends of two levers 33 and 33' supports a braking pad 34 and 34' cooperating respectively with braking surfaces 35 and 35' formed on the flanks of the wheel 36. In a variation, the surfaces 35 and 35' could be formed on a disk mounted fixedly on the axle of the wheel 36.

A connecting rod 37 connects the end of the arm 27 of the square 23 to the end of the lever 33 opposite the pad 34. To this end, this connecting rod is hinged at one of its ends on an axle 38 extending through the hole 28, and at its other end on an axle 39 mounted on the aforementioned end of the lever 33 opposite the pad 34.

The end of the lever 33' opposite the pad 34' is hinged on the lug 22 of the fixed member 20. The median zones of the levers 33 and 33' are connected by connecting links 41 fixed to axles 42 and 42', respectively.

When a traction is exerted on the brake triangle, it leads the square 23 to pivot in the direction of the arrow F2. The latter in turn leads the lever 33 to pivot in the direction of the arrow F3 about the axle 42. As a result, there is a support of the pad 34 on the braking surface 35, on the one hand, and a traction is exerted by the link 41 on the lever 33' in the direction of the arrow F4, on the other hand. Thus, the two pads 34 and 34' are applied on their respective braking surface 35 and 35'. Therefore, the tire 43 of the wheel 36, in this embodiment, is not biased.

Figure 10:
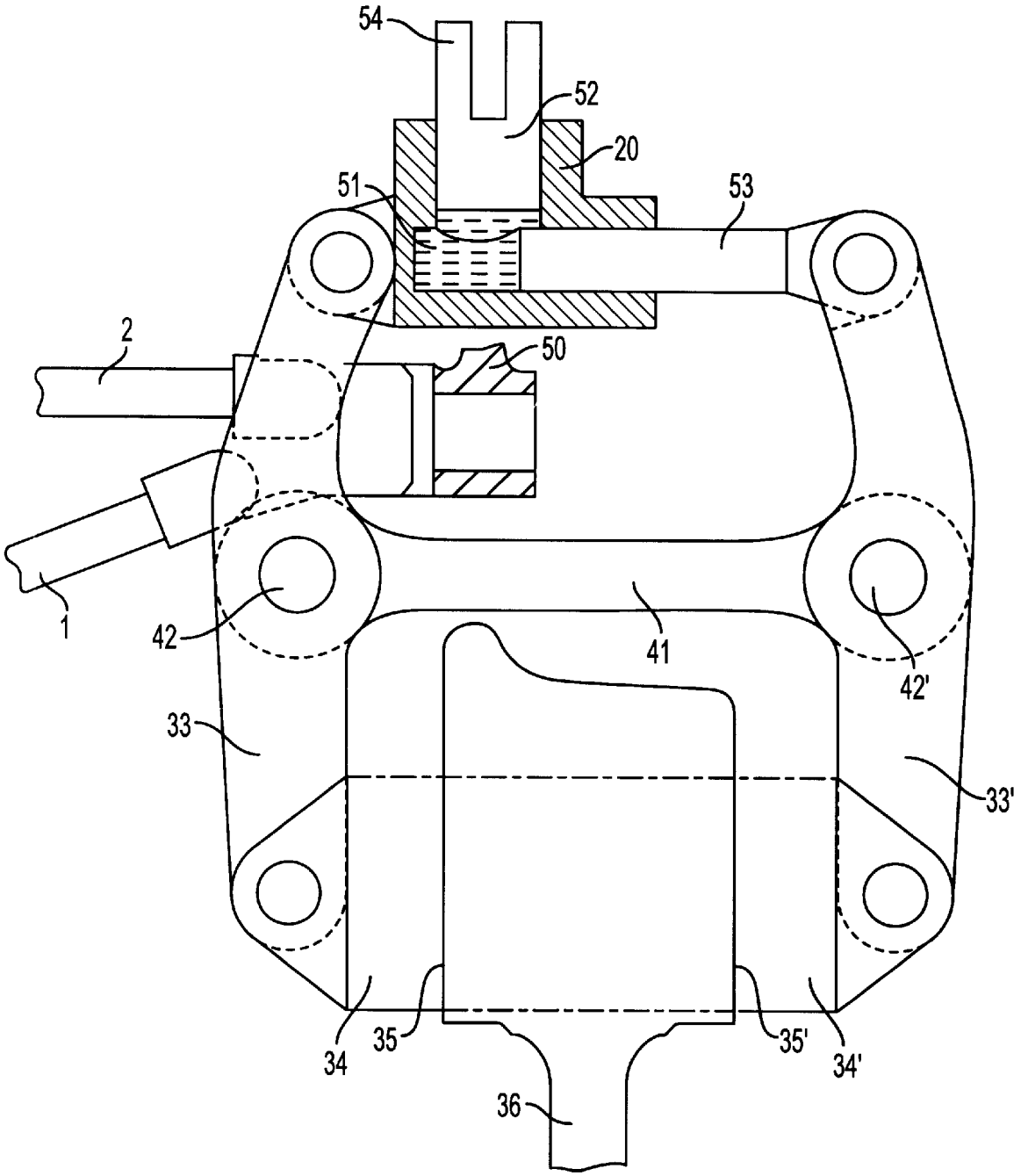
FIG. 10 is a top view of a fifth embodiment of the invention.

The embodiment of FIGS. 7 to 9 which has just been described includes a number of hinges the wear of which could in the long term eventually affect the efficiency of the system. The embodiment of FIGS. 10 and 11 allows to palliate this disadvantage while using the same working principle.

The brake triangle 1, 2 operates here on a link member 50. The member 20 has two hydraulic fluid receiving cavities 51, defining a cylinder, out of which two perpendicular pistons 52 and 53 protrude.

Figure 11:
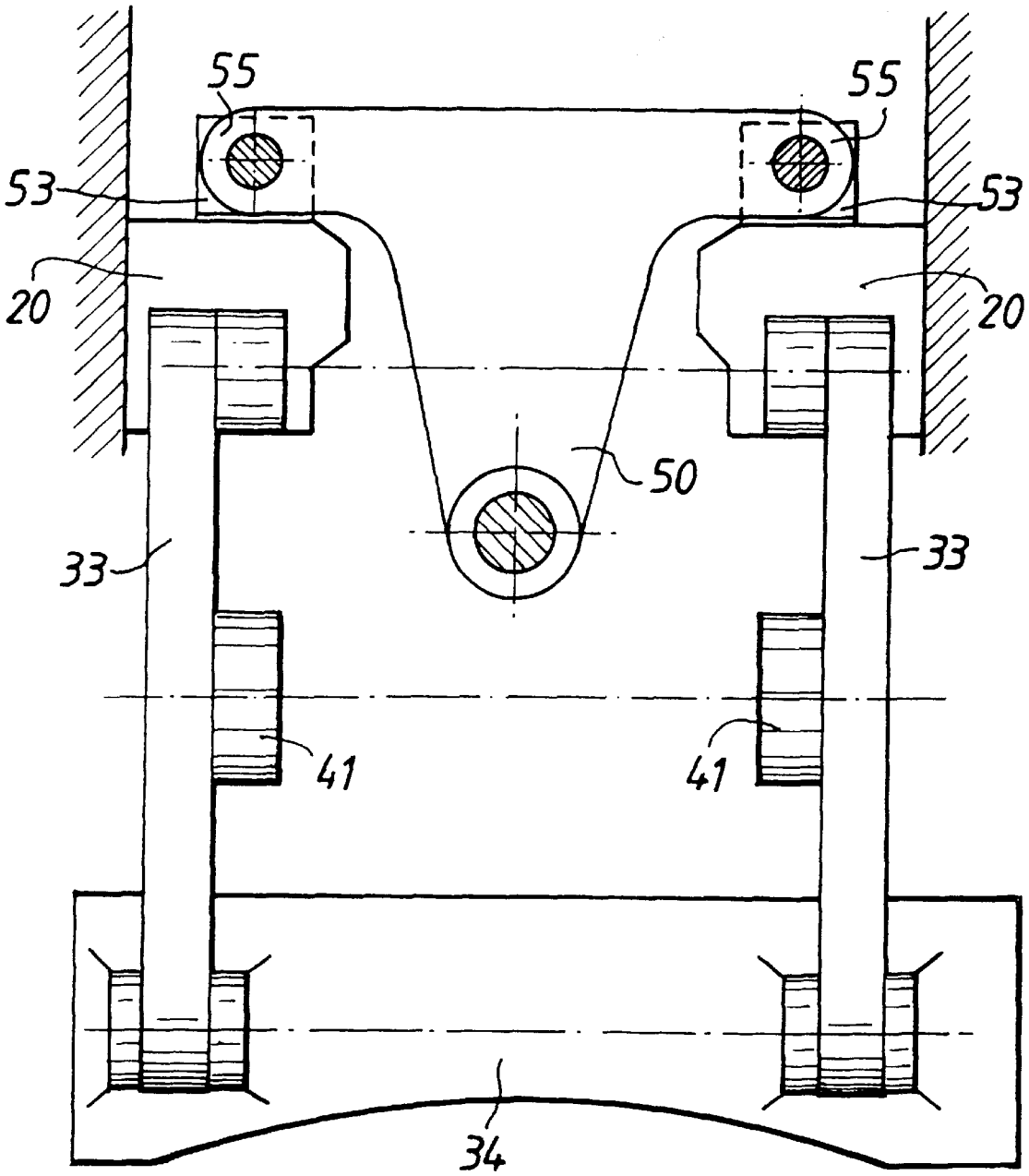
FIG. 11 is a side view of this embodiment.

The piston 52 is parallel to the traction direction of the brake triangle and has a fork 54 at its free end, which fork receives an ear 55 of the link member 50. The free end of piston 53 receives an end of lever 33' (which is double as can be seen in FIG.11) opposite pad 34'.

The end of lever 33 opposite the pad 34 is pivotally mounted on the fixed member 20.

Thus, when a traction is exerted by the brake triangle on the link member 50, it induces the sinking of piston 52 and consequently the going out of piston 53. The pad 34' is applied on the braking surface 35', and lever 33 is pivoted by means of link 41, pad 34 being in turn applied on its braking surface 35.

This embodiment is stronger than the previous one, and moreover it has a better adaptability because of the possible choice of pistons 52 and 53 areas.

What is claimed is:

1. Braking device for a railroad vehicle including a traction mechanism arranged to apply a braking pad on a braking surface affixed to a wheel of the vehicle, comprising:

a reaction member affixed to the structure of the vehicle;

at least one lever arranged to cooperate with said reaction member;

a connecting device between said traction mechanism and said lever, said braking pad being borne by said lever to be applied on said braking surface by pivoting of said lever under the action of said traction mechanism and of said reaction member;

two pad-holding levers;

a substantially at a right angle force transfer cylinder with a longitudinal piston connected to said traction mechanism;

a transverse piston;

one of said pad-holding levers being pivotally mounted at its end opposite the pad on the reaction member, and the other of the pad-holding levers having its end opposite the pad connected to the transverse piston; and said pad-holding levers being connected in their central zone by a connecting link.

2. Braking device according to claim 1, in which said braking surface is a planar annular surface substantially parallel to the plane of the wheel and coaxial with the wheel.

3. Braking device according to claim 1, including two affixed complementary braking surfaces, each associated with a pad and with a lever, the two pads exerting their forces in opposite directions on their respective braking surface.

4. Braking device for a railroad vehicle including a traction mechanism arranged to apply a braking pad on a braking surface affixed to a wheel of the vehicle, comprising:

a reaction member affixed to the structure of the vehicle;

at least one lever arranged to cooperate with said reaction member;

a connecting device between said traction mechanism and said lever, said braking pad being borne by said lever to be applied on said braking surface by pivoting of said lever under the action of said traction mechanism and of said reaction member;

said braking surface being a planar annular surface substantially parallel to the plane of the wheel and coaxial with the wheel;

two affixed complementary braking surfaces, each associated with a pad and with a lever, the two pads exerting their forces in opposite directions on their respective braking surface;

two pad-holding levers;

a substantially at a right angle force transfer cylinder with a longitudinal piston connected to said traction mechanism;

a transverse piston;

one of said pad-holding levers being pivotally mounted at its end opposite the pad on the reaction member, and the other of the pad-holding levers having its end opposite the pad connected to the transverse piston; and said pad-holding levers being connected in their central zone by a connecting link.

* * * * *